United States Patent [19]

Menke

[11] 4,194,929

[45] Mar. 25, 1980

[54] TECHNIQUE FOR PASSIVATING STAINLESS STEEL

[75] Inventor: Joseph T. Menke, Davenport, Iowa

[73] Assignee: The United States of America as represented by the Secretary of the Army, Washington, D.C.

[21] Appl. No.: 940,545

[22] Filed: Sep. 8, 1978

[51] Int. Cl.[2] ..... C23F 7/10

[52] U.S. Cl. ..... 148/6.15 R; 148/6.14 A; 148/31.5; 148/6.15Z; 204/56 R

[58] Field of Search ..... 204/56 R; 148/6.15 R, 148/6.15 Z, 6.14 A

[56] References Cited

U.S. PATENT DOCUMENTS

| | | | |
|---|---|---|---|
| 1,007,069 | 10/1911 | Coslett | 148/6.15 Z |
| 1,303,627 | 5/1919 | Baines | 204/56 R |
| 1,798,218 | 3/1931 | Pacz | 204/56 R |
| 2,356,575 | 8/1944 | Frasch | 204/56 R |
| 2,800,421 | 7/1957 | Goodspeed et al. | 148/6.14 A |
| 3,459,604 | 8/1969 | Freeman et al. | 148/6.14 A |
| 3,879,237 | 4/1975 | Faigen | 148/6.14 A |

*Primary Examiner*—Ralph S. Kendall

*Attorney, Agent, or Firm*—Nathan Edelberg; Robert P. Gibson; Robert O. Richardson

[57] ABSTRACT

Stainless steel is "activated" by blasting the metal surface with cast iron grit or cut steel blasting abrasive. Particles of ferrous metal abrasive are embedded in the corrosion resistant steel surface, causing a passive coating to form in a conventional phosphating or oxalating solution. This may be desirable to make the stainless steel surface non-reflective and more corrosion resistant.

3 Claims, 3 Drawing Figures

TECHNIQUE FOR PASSIVATING STAINLESS STEEL

GOVERNMENT RIGHTS

The invention described herein may be manufactured and/or used by or for the Government for governmental purposes without the payment of any royalty thereon.

BACKGROUND OF THE INVENTION

Stainless steel is steel alloyed with chromium, nickel and other elements. Materials referred to as stainless steel generally contain a minimum of 12% chromium. Its outer surface exposed to air forms a protective oxide coating. However, contrary to popular belief, stainless steel will corrode. It needs oxygen to maintain its protective capability and if there is no oxygen, stainless steel will corrode.

If stainless steel is to be coated with a black coating for non-reflective purposes, the stainless steel must be "activated" before the black coating will form on it. This requires removal of the protective oxide coating. This may be done by dipping it into an acid bath, usually sulfuric or hydrocloric acid. The activated stainless steel is then coated by emmersion in a blackening bath.

Cast stainless steel also requires corrosion-proofing. This steel is heat treated to get a desired high strength material. It corrodes readily due to the formation of an iron rich as-cast surface that readily corrodes when exposed to air.

SUMMARY OF THE PRESENT INVENTION

In accordance with one form of the present invention, stainless steel is "activated" by abrasive blasting with steel grit to remove the protective oxide coating. This grit is embedded into the surface, making the surface suitable for phosphating by spray or dip techniques. This treatment forms a protective "passive" coating over which supplementary coatings of paint, lubricating oils, or preservative compounds may be added, if desired. Cast stainless steel may be phosphated without steel grit blasting, since its surface is already iron-rich.

The embedded particles of ferrous metal abrasive generates a galvanic potential with the base metal and constitute local anodes when the treated steel is immersed in an electrolyte. A large cathode, small anode area relationship is established between the embedded metal anodes and the larger corrosion resistant steel cathode. When further treated in an acid phosphate solution or spray of heavy metal ions such as zinc, manganese or iron, a progressive depletion of the embedded ferrous metal anodes occurs, and a simultaneous electrolytically equivalent cathode reaction occurs, resulting in an extremely corrosion resistant surface. This reaction is self terminating, ending when equilibrium is reached; i.e., when all anode and cathode reactions have been completed. A completely passive surface remains.

DETAILED DESCRIPTION OF ILLUSTRATIVE EMBODIMENTS

Figure 1:
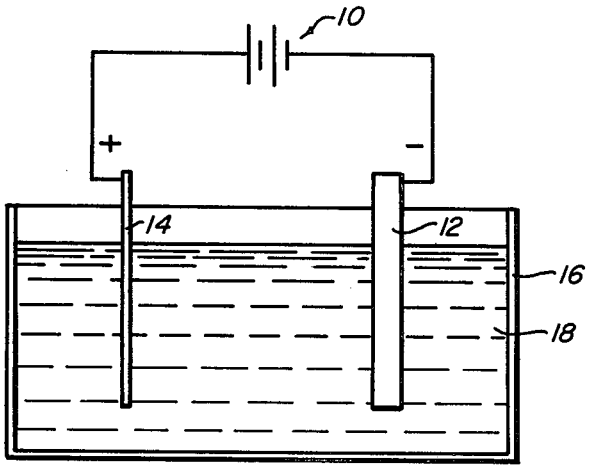
FIG. 1 is a schematic illustration of apparatus in practicing one form of the present invention.

Reference is now made to FIG. 1 wherein there is shown a battery source 10 having a negative terminal connected to a cathode 12 and a positive terminal connected to an anode 14. The anode and cathode are positioned in a container 16 of phosphate solution 18.

The phosphate solution 18 is typically that which is commercially available and may be any of the phosphating baths disclosed in U.S. Pat. No. 3,767,476 which issued Oct. 23, 1973 to Linden H. Wagner and Paul G. Chamberlain for Method and Composition for Phosphatizing Steel Under Pressure, for example. Also oxalate conversion coating solutions may be used. One such solution is set forth in U.S. Pat. No. 2,137,968 which issued Nov. 22, 1938 to Robert Tanner for Coated Iron Article.

The cathode 12 is the stainless steel part to be treated. The anode 14 is a typical inert anode to make the stainless steel cathodic. Typically it is a material down the Galvanic Chart from stainless steel such as graphite, platinum or gold. Even stainless steel may be used. Such Galvanic Chart may be found on page 416 of Corrosion Handbook by Herbert H. Uhlig and published in 1948 by John Wiley and Sons, Inc.

The current from battery 10 may be from 0.5 to 1.5 amps at 3 to 5 volts DC applied for about 15 minutes. It should be understood that this is not a conventional electroplating operation as metal from the anode is not used to plate the cathode. The anode simply completes the circuit making the stainless steel surface cathodic so a phosphate coating can begin to form. After starting, and after the phosphate coating begins to form, the circuit may be disconnected.

Figure 2:
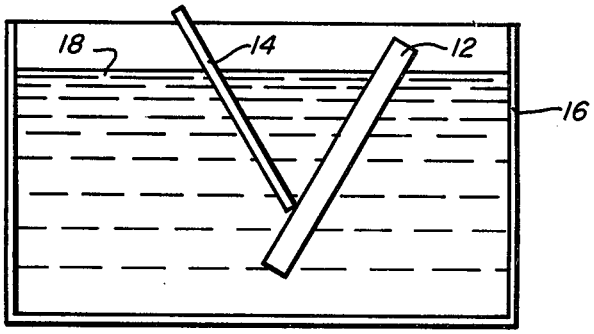
FIG. 2 is a schematic illustration of an alternate apparatus.

Referring to the embodiment in FIG. 2 a phosphate solution 18 is in container 16. Item 12 is the stainless steel part. Item 14 may be any material above stainless steel on the Galvanic Chart. Such material may be magnesium, zinc, aluminum, or steel. Item 12 becomes the cathode and item 14 the anode upon contact in the solution. When the anode 14 contacts the cathode 12 in the phosphate solution, a chemical conversion treatment commences. The phosphate coating starts to form on the cathode 12 without the use of a current, as in FIG. 1.

Figure 3:
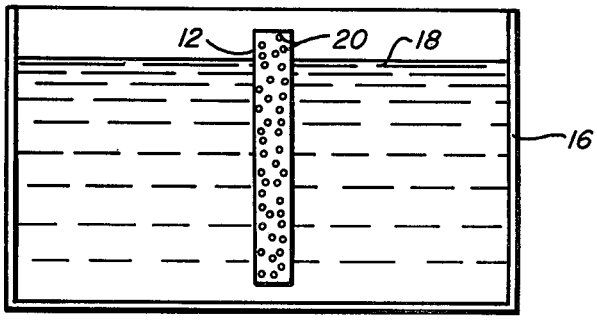
FIG. 3 is a schematic illustration of still another apparatus.

A third way of making the stainless steel cathodic is to embed it with particles of ferrous metal abrasive before submersion into the phosphate solution. In FIG. 3 the stainless steel panel 12 is shown with steel grit 20 embedded in its surface. In one application grit of 80 mesh size was applied with a force of 80 to 120 pounds per square inch pressure. These embedded particles generate a galvanic potential with the stainless steel and constitute local anodes when the treated steel is immersed in an electrolyte. When treated in an acid phosphate solution a progressive depletion of the embedded ferrous metal anodes occurs, and a simultaneous electrolytically equivalent cathode reaction occurs, resulting in an extremely corrosion resistant surface. This reaction is self terminating, ending when equilibrium is reached; i.e., when all anode and cathode reactions have been completed. A completely passive surface remains.

The invention in its broader aspects is not limited to the specific combinations, improvements and instrumentalities described but departures may be made therefrom within the scope of the accompanying claims without departing from the principles of the invention and without sacrificing its chief advantages.

What is claimed is:

1. A method of passivating stainless steel comprising the steps of:

a. Making the stainless steel cathodic by first embedding ferrous metal abrasive anode particles on the surface thereof, and b. Subjecting said stainless steel to a phosphating conversion coating solution.

2. The method of passivating stainless steel as in claim 1 wherein said particles are of 80 mesh size and are embedded under pressure of 80 to 120 pounds per square inch.

3. The method of passivating stainless steel, as in claim 1 wherein said particles are of a material above that of stainless steel on the Galvanic Chart.

* * * * *